United States Patent [19]

Uchino et al.

[11] 3,989,983

[45] Nov. 2, 1976

[54] LIGHT SOURCE APPARATUS

[75] Inventors: Koichi Uchino; Hideaki Koizumi, both of Katsuta, Japan

[73] Assignee: Hitachi, Ltd., Japan

[22] Filed: Jan. 28, 1975

[21] Appl. No.: 544,759

[30] Foreign Application Priority Data

Jan. 30, 1974 Japan ..... 49-11826

[52] U.S. Cl. ..... 315/248; 313/15; 313/44

[51] Int. Cl.[2] ..... H05B 41/16

[58] Field of Search ..... 315/248, 267, 344; 313/44, 15

[56] References Cited

UNITED STATES PATENTS

| | | | |
|---|---|---|---|
| 1,897,586 | 2/1933 | Pirani | 313/44 |
| 2,975,330 | 3/1961 | Bloom et al. | 315/248 X |
| 3,048,738 | 8/1962 | Paul | 315/248 X |
| 3,786,308 | 1/1974 | Browner et al. | 315/248 |

*Primary Examiner*—R. V. Rolinec
*Assistant Examiner*—Darwin R. Hostetter
*Attorney, Agent, or Firm*—Craig & Antonelli

[57] ABSTRACT

An ampoule shaped electrodeless discharge tube, including a large-diameter portion and a small-diameter portion, is filled with luminous elements and inactive gas. The discharge tube is placed in a housing having a lighting window from which the light emitted by the elements is extracted. A high-frequency coil is wound around the large diameter portion at the middle portion of the discharge tube. A partition wall provided in the housing partitions the housing into a first and a second compartments. The middle portion of the discharge tube and the small diameter portion are placed in the first compartment, while the end portion of the discharge tube opposite to the small-diameter portion is placed in the second compartment, and is cooled with air-flow flowing from the inlet to the outlet, both of which are formed to the housing. When high-frequency power is supplied to the coil, the luminous elements in the discharge tube is excited to luminesce. The light thus emitted is extracted to the exterior, through the lighting window. Unvaporized elements are localized at the portion to be cooled by the air-flow.

39 Claims, 9 Drawing Figures

LIGHT SOURCE APPARATUS

BACKGROUND OF THE INVENTION

The present invention relates to a light source apparatus with an electrodeless discharge tube, and more particularly to one suitable for atomic absorption analysis apparatus, atomic fluorescence analysis apparatus, etc.

A spectroscopic electrodeless discharge tube is normally a lamp made of quartz being filled with rare gas and luminous metal, salt with metal or amalgam. The electrodeless discharge tube, as the hollow cathode lamp, can be used as a light source for atomic absorption analysis apparatus, because it can be used as a bright-line spectrum source. Few electrodeless discharge tubes, however, have been employed as the light source for the atomic absorption analysis apparatus. The main reason for this is that the conventional electrodeless discharge tube has a poor absorbance compared with the hollow cathode lamp and that it fails to have a light intensity stable for a long time. The poor absorbance is probably due to self-absorption and a broad doppler width.

Elementary vapour pressure in the electrodeless discharge tube must be kept about $10^{-3}$ Torr for lighting the electrodeless discharge tube. Under such vapour pressure, the elementary vapour in the discharge tube acts to constantly condense on the low temperature portion of the discharge tube inside wall, under the vapour pressure of phase equilibrium. Thus, if the low-temperature portion is localized near the lighting portion, a portion from which the light emitted by the elements is extracted from the discharge tube, the elementary vapour condenses on the discharge tube inside wall corresponding to the lighting portion, thereby resulting in reduction of light intensity. If the low temperature portion is localized on the inside wall of the discharge tube portion wound by the high-frequency coil, the metal vapour deposits thereon and serves to shield the high-frequency energy applied by the coil. The result is that the electrodeless discharge tube stops to luminescing.

The intensity of the light emitted from the elements in the electrodeless discharge tube depends on the vapour pressure of the elements filled therein, and the vapour pressure is based on the surface temperature of the elementary drops existing in the discharge tube. An action of the elementary drops when the discharge tube is lit up will be explained referring to the case of a mercury electrodelss discharge tube. Spattered mercury drops were inherent to such conventional tube. Upon lighting of the discharge tube, the vapour from the mercury drops laid on the highest-temperature portion of the discharge tube diffuses into the space of the tube and condenses on the inside wall of the tube at a low temperature. The diffusion of the mercury drops laying on that portion continues until the mercury drops disappear. Following this, the mercury drops laying on the discharge tube inside wall where the temperature is high next to that of the former portion, are vapoured to diffuse in the electrodeless discharge tube and then to condense on the low-temperature temperature portion of the discharge tube wall. This process will be repeated and, finally, the mercury drops remain at only the low-temperature portion of the tube wall. For this reason, the high intensity of the discharge tube remains unstable for a short time after the lighting-up of the tube. The spattered low-temperature portions along the discharge tube wall incur the reduction of the light intensity and more adversely the stopage of the luminescence in the tube.

The electrodeless discharge lamp may also be used as a light source for atomic absorption analysis apparatus applying the Zeeman effect. A detailed Zeeman atomic absorption analysis is set forth in the U.S. Patent Application No. 474,812, filed in 1972. In the Zeeman atomic absorption analysis, one of the components of a spectral line split by a magnetic field applied is used for light of a sample, while another one is used for light of a reference. The electrodeless discharge lamp used as a light source for the known Zeeman atomic absorption analysis apparatus physically had a diameter of 10 mm or more, and a tube with a high-frequency coil therearound is provided in the gap between the magnetic poles of the magnet. The gap permits the light emitted to travel outside. Such constructed light source involves many problems, other than above mentioned ones: The magnet used must be of large size, due to the broad gap between the magnetic poles; The guidance of the light emitted from the elements in the discharge tube to the exterior is continued in the direction of the magnetic field applied to the elements; A uniform magnetic field can not be obtained because of the opening bored in the magnet.

SUMMARY OF THE INVENTION

An object of the present invention, thus, is to provide a light source suitable for atomic absorption analysis apparatus.

Another object of the present invention is to provide a light source with stable light intensity, i.e., with little variation of light intensity with respect to time.

Still another object of the present invention is to provide a light source in which a short time is required until the light intensity becomes stable, after the lighting of the discharge tube.

Other object of the present invention is to provide a light source having an electrodeless discharge tube with little self-absorption for the light emitted.

Another object of the present invention is to provide a light source yielding light of high light intensity and eliminating the stoppage of luminescence after a short lighting operation.

Other object of the present invention is to provide a light source capable of easily controlling the amount of the vapour of the elements produced in an electrodeless discharge tube.

Another object of the present invention is to provide a light source suitable for extraction of the light split by Zeeman effect.

In the present invention, a part of an electrodeless discharge tube filled with an element contributing to the luminescence and an inactive gas is kept lower in temperature then the other parts thereof. This causes drops of unvaporized elements to be localized on the inside wall of the discharge tube and not to be spattered thereon. By an application of high-frequency energy to the vapour of the element, the discharge tube is lit up, enabling the emission of the light.

In a preferred embodiment of the present invention, the electrodeless discharge tube is provided with a large-diameter portion with a high-frequency coil wound therearound and a small-diameter portion from which the light is extracted. The portion where the non-vaporized-element is localized is located away from the portion with the high-frequency coil as well as the portion from which the light is extracted.

Other objects, advantages and features of the present invention will be apparent from the following description taken in connection with the accompanying drawings, in which:

DETAILED DESCRIPTION OF PREFERRED EMBODIMENTS

Figure 1:
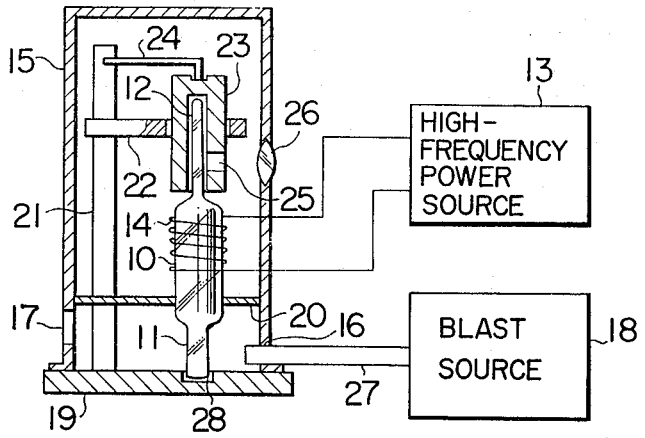
FIG. 1 is a longitudinal sectional view in part illustrating a schematic construction of an embodiment according to the present invention.

An electrodeless discharge tube is made of transparent and heat-resisting material such as quartz, glass or the like. When the electrodeless discharge tube is supplied with high-frequency energy, the elementary vapour filled in the electrodeless discharge tube emits light. The emitted light has bright-line spectra with wavelengths peculiar to the element filled.

A feature of the present invention is that a temperature gradient is provided along the tube wall of the electrodeless discharge tube, or a part of the electrodeless discharge tube is made distinguishably lower in temperature in comparison with the other parts thereof. Luminous elements are previously placed in the lowest-temperature portion of the discharge tube or the filled elements condense on the lowest-temperature portion thereof.

The portion to be kept at the lowest-temperature is placed away from the portion with the high-frequency coil wound therearound and the portion from which the emitted light is extracted, i.e., a lighting portion. The vapor pressure of phase equilibria of the element filled in the discharge tube depends on the lowest temperature of the tube wall, so that the vapour pressure of the element in the discharge tube may be controlled by controlling the temperature at the lowest-temperature portion of the discharge tube. The lighting portion is disposed away from the place where the high-frequency energy is applied. The diameter of the lighting portion is smaller than that of the portion at which the high-frequency energy is applied, so that self-absorption of the element for the emitted light is reduced and a large-light intensity is extracted. The diameter of the conventional electrodeless discharge tube utilized in the light source means is 10 mm or more so that self-absorption for the light emitted is large. Nevertheless, in the conventional electrodeless discharge tube, it was very difficult to reduce the diameter of the lighting portion of the discharge tube since the portion applied with the high-frequency energy and the lighting portion, i.e., the portion where the light emitted is extracted to the exterior were provided at the substantially the same place in the discharge tube. This is because it has not been known that the slender portion of the discharge tube being disposed away from the portion for applying the high-frequency energy may also be a light emission place. However it is impractical to make the whole of the discharge tube slender since, if so, the application of high-frequency energy is difficult and the amount of inactive gas filled therein is reduced.

Since the lowest-temperature portion is disposed away from the lighting portion and the portion for applying high-frequency energy, the condensation of the elementary vapour filled in the tube is not performed at the lighting portion and the portion for applying the high-frequency energy. Therefore, a large light intensity may be obtained and the disadvantage is eliminated that the discharge tube will stop to luminesce in a short time after lighting operation. The condensed elementary drops are confined to a predetermined portion. That is, these drops are not spattered over the inside wall of the discharge tube. As a result, the light intensity is rapidly stabilized after the discharge tube is lit, and the stabilized light intensity is enabled to continue.

In case an element varpourizable at normal temperature is used, it is unnecessary to employ a heating means, while, when an element hard to vaporize at the normal temperature is used, it is necessary to employ a device to keep the temperature of the discharge tube high enough to vaporize the elements filled.

In a preferred embodiment according to the present invention, the local part of the discharge tube, i.e., the element sink, is subjected to an air stream or placed in a constant-temperature fluid, for maintaining the lowest temperature thereat, the after portion thereof is subjected to a high-frequency electromagnetic field, resulting in raising of the temperature of that portion, and thus preventing the elementary vapour from condensing at the portion for the high-frequency energy portion and at the lighting portion.

In another preferred embodiment according to the present invention, the element sink is controlled by an air-flow to be at the temperature capable of providing a desired vapour pressure, while the other portion thereof is kept at high temperature by a heating means.

In another preferred embodiment of the present embodiment, the slender portion of the discharge tube is placed in an intensitive magnetic field. In case the lighting portion and the portion for applying the high-frequency energy are substantially at the source place, as in the prior art, the portion for applying the high-frequency energy is place in the intensitive magnetic field for obtaining the Zeeman splitted lights, so that the discharge tube stops to luminescing. However, when the slender portion of the discharge tube is disposed at a distance from the portion thereof where the high-frequency energy is applied, and placed in the intensive magnetic field, the discharge tube fails to meet the stoppage of luminescence and, rather, the slender portion thereof emits more intensive light. Furthermore, the portion thereof where the high-frequency energy is applied is not placed between the magnetic poles. For this, the Zeeman splitted lights are taken out in the direction normal to the magnetic field.

The present invention may be altered or modified within the spirit of the present invention. It is to be noted that the embodiments heretofore described are just examples for better understanding the present invention.

FIG. 1 shows a longitudinal sectional view in part of an embodiment according to the present invention. In FIG. 1, an electrodeless discharge tube 10 made of transparent material such as quartz or glass is filled with inactive gas and mercury. The electrodeless discharge tube 10 includes one end portion 11 for containing non-vaporized-elements, i.e., element sink, the other end portion 12 of small diameter, and the middle portion with a high-frequency coil 14 wound therearound. The high-frequency coil 14 is connected with a high-frequency power source 13. A housing comprising a cover 15 and a base member 19 is provided with an air outlet 17 and an air inlet 16 into which a blast pipe 27 coupled with a blast source 18 comprising a blower is fitted. The blast pipe 27 is directed at one end toward the element sink 11. A pole 21 fixed to the base member 19 is provided with a guide plate 22 having a hole permitting a cap 23 passing therethrough and a spring member 24 for pressing the cap 23 down. The discharge tube 10 is stably held by fitting one end thereof to the cap 23 and inserting the other end into a concavity 28 of the base member 19. The slender end 12 of the discharge tube 10 is covered with the cap 23 having a lighting opening 25 through which the light emitted from the slender end 12 is taken out or extracted. A condensing lens 26 is mounted in the cover 15. A partition wall 20 being positioned between the element sink 11 and the middle portion with the high-frequency coil 14 is provided for preventing the air flow passing the element sink 11 from flowing into the compartment containing the lighting portion 12, the portion with the high-frequency coil 14, etc. When the coil 14 is energized by the high-frequency source 13, the high-frequency energy excites the mercury filled in the discharge tube 10 to luminesce it in the slender portion 12 and the middle portion of the discharge tube 10. The emitted light is emitted through the lighting opening 25 and the condensing lens 26 for measurement. The element sink 11 of the discharge tube 10 is placed in the air flow so that the temperature at the element sink is kept substantially at air temperature. The temperature at the portion with the coil 14 wound therearound rises 10° C or more higher than air temperature. The temperature at the slender portion 12 of the discharge tube 10 rises 5° to 10° C higher than air temperature, since heat dissipation from the slender portion 12 is prevented by the cap 23. Accordingly, the element sink 11 is at the lowest temperature in the discharge tube 10 and the non-vaporized-mercury is gathered therein. This embodiment is suitable for a light source with a discharge tube filled with an element of a high vapour-pressure, i.e., the element varpourizable at a relatively low temperature.

Figure 2:
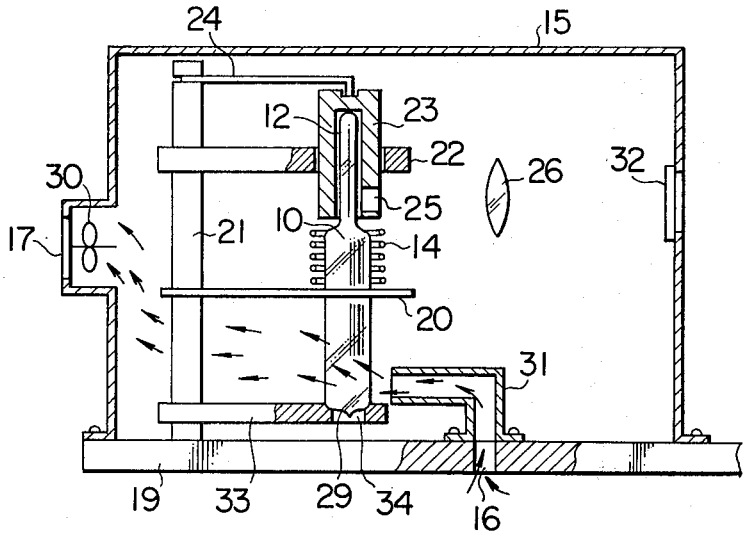
FIG. 2 is a longitudinal sectional view in part illustrating a schematic construction of a modified embodiment of FIG. 1.

FIG. 2 is a longitudinal sectioned view in part of a modified embodiment of FIG. 1. A bottom plate 33 with a hole 34, a patition plate 20, a guide plate 22 and a spring member 24 are mounted to the pole 21 fixed to a base member 19. An electrodeless discharge tube 10 is held by a cap 23 and the bottom plate 34. A high-frequency coil 14 wound around the discharge tube 10 above the partition plate 20 is coupled with a power source (not shown). The base member 19 is provided with an air inlet 16 and an air pipe 31. One end of the air pipe is directed near the lower end portion 29 of the discharge tube 10. The cover 15 is provided with an air outlet 17 to which an exhaust fan 30 driven by a motor (not shown) is mounted. The emitted light is directed to the exterior of the cover 15 through a light opening 25, a condensing lens 26 and a window plate 32. Most of the air flowing from the inlet 16 flows through a path defined by the partition plate 20 and the bottom plate 33 by the operation of the exhaust fan 30 and finally it is exhausted outside through the air outlet 17. Accordingly, the lower end portion 29 of the discharge tube 10 is kept at the lowest temperature of all portions of the discharge tube 10. This embodiment is suitable for using an element varpourizable at the normal temperature, for example, mercury.

Figure 3:
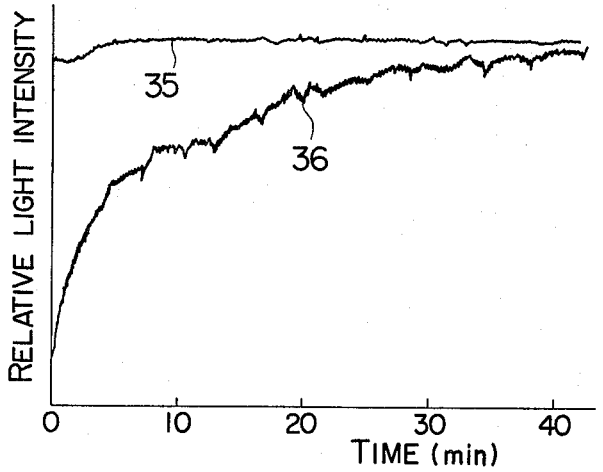
FIG. 3 is a graph in which, with a light source of FIG. 2, the case where the discharge tube is in part kept at lowest temperature, and the case where the entire of the discharge tube is kept at the same temperature, are compared with respect to the stability of light intensity shortly after the discharge tube is lit.

FIG. 3 is a diagram showing the stability of the light intensity of the discharge tube shortly after the lighting thereof in the two cases where the lower end portion of the discharge tube is kept at the lowest temperature of all portions of the tube and where the whole of the discharge tube is kept at substantially the same temperature. This experiment was carried out by using the light source in FIG. 2. In the diagram of FIG. 3, the abscissa represents the elapse of time after the lighting of the discharge lamp, while the ordinate represents the relative light intensity. As seen from two curves 35 and 36, the time required for the light intensity to be stable after the commencement of the lighting of the discharge lamp, takes about 5 min., when the lower end of the discharge lamp is at the lowest temperature, as illustrated by the curve 35, while about 25 min. is needed, when the whole of the discharge lamp is kept at substantially the same temperature, as illustrated by the curve 36. It is noted that these data are collected by using an ampoule-shaped electrodeless discharge tube, and not a conventional electrodeless discharge tube. It is different in shape from the discharge tube in FIG. 2, but not so much different in the characteristics of the stability of the light intensity from the discharge tube in FIG. 2 in the case shown by the curve 36. According to the present invention, the time required until the photometry is commenced after the lighting of the discharge tube is remarkably shortened. The light intensity variation after the light intensity reaches a substantially constant value is about 0.5% for the curve 35, while about 2% for the curve 36. Thus, the precision of analyses is improved, by applying the present invention.

Although it is rare that the room temperature rapidly changes for a short time, a constant temperature device may be coupled with the air inlet 16 in FIG. 2 if it is necessary to keep the temperature of the local part, i.e., the lower end, of the discharge tube at a constant temperature.

Figure 4:
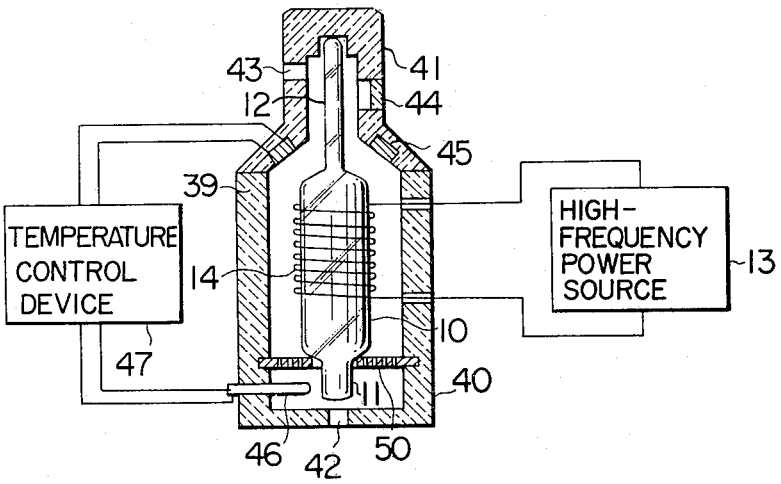
FIG. 4 is a longitudinal sectional view in part illustrataing a schematic construction of another embodiment of the present invention.

FIG. 4 shows a longitudinal sectional view in part of another embodiment of the present invention. This embodiment is preferable when it is applied to the case using an element hard to vaporize at normal temperature. The electrodeless discharge tube 10 of quartz includes an element sink 11 for containing the luminous element. As in the discharge tube of the previously mentioned embodiment, the upper portion 12 of the discharge tube 10 has a diameter smaller than that of the middle portion thereof, so as to reduce the self-absorption for the light emitted. The discharge tube 10 is filled with trace amounts of elements such as lead, cadmium, zinc, etc. and inactive gas, for example, argon gas. A furnace 39 comprising an adiabatic box 40 and, cap 41 s provided with a heater 45 for heating the inside of the furnace 39. An air inlet 42 is formed at the bottom of the furnace 39, and an air outlet 43 is formed at the cap 41. The cap 41 also is provided with a transparent light window 44. The discharge tube 10 is held by the cap 41 and a holding plate 50 having a number of holes permitting air therethrough. It is to be noted that the discharge tube 10 may be held by using other appropriate means. The middle portion of the discharge tube is wound by the high-frequency coil 14 coupled with the high-frequency power source 13. A heat sensor 46 using a thermocouple such as an alumel-chromel couple, a platinum-platinum-rhodium couple, etc., is arranged near the element sink 11 in the furnace 39. A temperature control device 47 controls the ON-OFF operation of the heater 45 so as to maintain the temperature in the vicinity of the element sink 11 constant.

Upon supply of high-frequency energy through the coil 14 to the discharge tube 10, the discharge tube 10 starts to luminesce. In the thus shaped discharge tube, the slender portion 12 of the discharge tube as well as the center portion thereof luminesce intensively. The light emitted is directed through the lighting window 44. In this embodiment, the air inlet 42 is formed at the bottom of the furnace, as previously mentioned, so as to allow a small amount of the external air at normal temperature to flow into the furnace 39. The air in the furnace 39 heated by the heater 45 flows upwards and is exhausted outside through the air outlet 43. This constructed light source enables the temperature in the vicinity of the element sink 11 to be kept constant, so that the vapour pressure of the element in the discharge tube 10 depends on the temperature of the element sink 11, in accordance with the principle of phase equilibria between the solid phase and liquid phase.

About $10^{-3}$ Torr is the vapour pressure of the element in the discharge tube 10 to ensure luminascence. When argon gas is filled at the pressure of 1 to 5 Torr in the discharge tube 10, the temperature sufficing for that vapour pressure is about 230° C for cadmium, 290° C for zinc, and 630° C for lead. When cadmium, for example, is employed as the luminous element to be filled, an excellent luminescence may be obtained with the element sink 11 at a constant temperature of about 230° C and the other portions of the discharge tube 10 at about 300° C.

Figure 5:
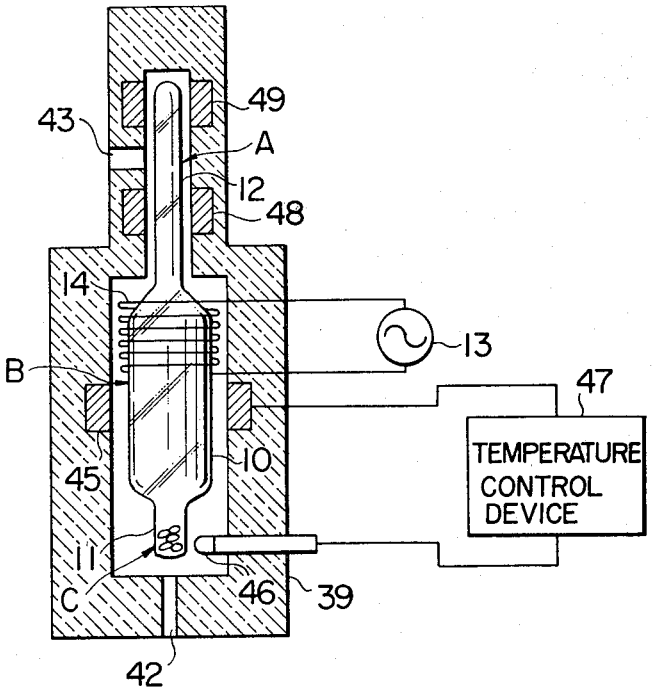
FIG. 5 is a longitudinal sectional view in part illustrating a schematic construction of the modification of FIG. 4.

FIG. 5 is a modification of the embodiment of FIG. 4. Differences thereof from the light source of FIG. 5 are as follows: The shape of the furnace is slightly different; A hole 43 serves both the air outlet and the light window; A plurality of heaters 45, 48 and 49 are provided in the furnace 39. Other portions of the light source are substantially the same as those of FIG. 4. The light source of this embodiment is designed for sufficing for the following relation $$T_A \geqq T_B > T_C$$

where $T_A$ is temperature near the light portion A, $T_B$ is temperature near the coil B and $T_C$ is temperature near the element sink C. The temperature near the element sink C is kept much lower than that of the other portions thereof. The air in the furnace 39 heated by the heater 45 flows upward and then is heated again by the heater 48 and finally is exhausted through the air outlet 43. The uppermost portion of the discharge tube 10 is heated by the heater 49, so that the temperature of the upper part of the discharge tube 10 is higher than that of the lower part thereof.

Figure 6A:
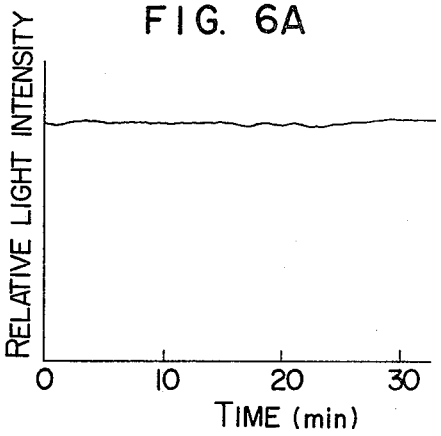
FIG. 6 (A) and (B) are graphs, respectively, for comparing the stability of light intensity by a cadmium light source.
Figure 6B:
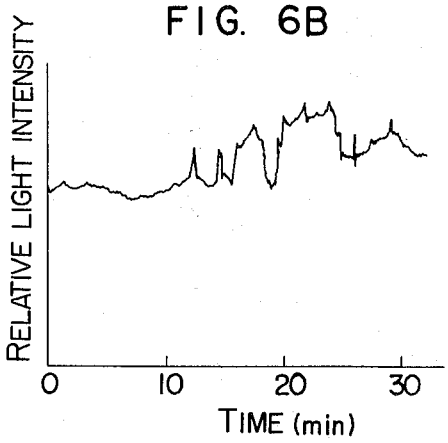

In FIG. 6, a comparison is made of the stability of light intensity when cadmium at 2280 A is used, for ascertaining the effects of the present invention. The curve in FIG. 6A is for the case where the element sink is placed at a low temperature comparing with the other portions thereof. The curve in FIG. 6B is for the case where the discharge tube is placed in the furnace with no air flow therein, and the whole of the discharge tube 10 is uniformly heated. The light source in FIG. 5 is used in both the cases. The measurement time is depicted along the abscissa at each graph, while the relative light intensity along the ordinate thereof. In the case of FIG. 6B the light intensity of cadmium is unstable since the low-temperature spots are spattered over the electrodeless discharge tube. On the contrary, in the case of FIG. 6A, the light intensity is stable, since the vapour pressure of cadmium in the discharge tube may be controlled by controlling the temperature of the element sink, and no cadmium vapour condenses on the other portions of the discharge tube wall. The variation of the light intensity in FIG. 6A is one-tenth as large as that of FIG. 6B.

Figure 7:
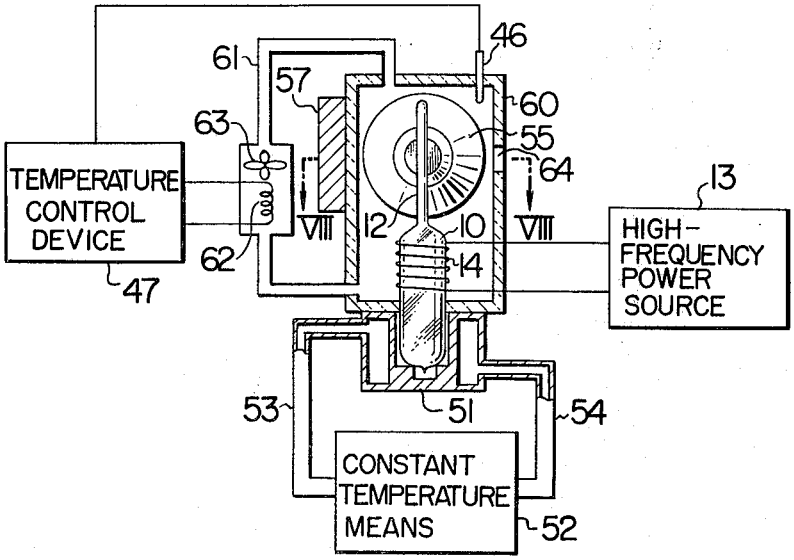
FIG. 7 is a longitudinal sectional view in part illustrating a schematic construction of still another embodiment of the present invention.
Figure 8:
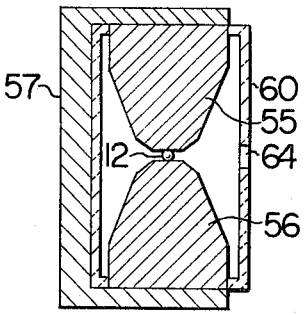
FIG. 8 is a cross sectional view taken along the line VIII–VIII of FIG. 7.

FIG. 7 is a longitudinal sectional view in part illustrating a schematic construction of another embodiment according to the present invention. FIG. 8 is a cross sectional view taken along the line VIII-VIII in FIG. 8. The light source in FIG. 7 is suitable when it is desired to use Zeeman split light for the light source.

The electrode discharge tube 10 in the figures is filled with an element which is relatively easy to vaporize, such as mercury, cadmium, lead, zinc, etc., and inactive gas. The discharge tube 10 includes a slender portion 12 and a center portion with the high-frequency coil wound therearound which is connected to the high-frequency power source 13. The electrodeless discharge tube 10 is held by a lamp holder 51 in which fluid at a fixed temperature, e.g. water, circulates to cool the lower portion of the discharge tube so as to obtain a desired vapour pressure of the element. A constant temperature means 52 such as a heat exchanger is coupled with an inlet pipe 54 and an outlet pipe 53. The slender portion 12 of the discharge tube 10 is placed in the gap between the magnets 55 and 56 made of an Al-Ni-Co system. The portion with the high-frequency coil 14 wound therearound is place out of the gap. Other magnets with a high coercive force made of a Fe-Ni-Co system or a rare earth system, for example, may be used for the magnets 55 and 56. A physical embodiment of the discharge tube 10 had an outer diameter of about 4 mm at the slender portion 12 and an outer diameter of 10 mm or more at the other portions. It is desirable that the other diameter of the slender portion 12 is as small as possible, and preferably less than 5 mm. A magnetic field of about 15 Kilo-gauss was obtained by using a small permanent magnet of about 5 kg with a gap of about 4 mm between the magnets 55 and 56. The central portion and the slender portion 12 of the discharge tube 10, and the magnets 55 and 56 are mounted in a constant temperature bath 60. The constant temperature bath 60 is provided with a circulating pipe 61 having a heater 62 and a fan 63. The heater 62 and a temperature sensor 46 are connected with a temperature control device 47, whereby the air in the constant temperature bath 60 to be circulated by the fan 63 is kept at a fixed temperature. The temperature of the portions of the discharge tube 10 disposed in the constant temperature bath 60 is higher than that of the portion thereof implantd in the lamp holder 51. By such temperature gradient, the nonvapourized-element in the discharge tube 10 is gathered at the lower portion of the discharge tube 10. The constant-temperature bath 60 is provided with a light window 64.

With this constructed light source, when high-frequency power of 50 to 100 MHz is applied to the high-frequency coil 14, the entire of the electrodeless discharge tube emits lights, and particularly the slender portion thereof emits intensive light. The bright-line spectra emitted in the vicinity of the gap between the magnetic poles exhibits Zeeman splitting. The magnetic device may be a small type due to the fact that the slender portion 12 is the object to wich the magnetic field is applied. If the magnetic pole gap is shortened one-third of the conventional one, the size of the magnet may be reduced one-tenth of the conventional one. The discharge tube 10 takes an ampoule shape. For this, the magnetic field may be applied to the slender portion 12 of the discharge tube 10 which is disposed away from the center portion with the high-frequency coil 14, with the result achieving the utilization of Zeeman split light. As a onsequence, stable light intensity may be attained without extinguishing luminescence in the discharge tube caused by application thereto of the magnetic field. This is an important fact when considering the extraction of the Zeeman split light. The light from the slender portion 12 of the discharge tube has a feature that self-reversion of spectral line caused by the self-absorption is very small. The thick portion for applying high-frequency energy is located away from slender lighting portion. This enables the light easily to be emitted in the direction normal to the magnetic field. Therefore, $\pi$ and $\sigma$ components are easily measured in atomic absorption analysis utilizing the Zeeman effect and thus the light source according to the present invention is applicable for analyzing the element without a stable isotope.

In still another embodiment of the present invention, the slender lighting portion is at the middle of the discharge tube, while the thick portion for applying the high-frequency energy is disposed at both ends of the discharge tube. It also is to be noted that the lighting portion and the high-frequency energy applying portion are separately disposed from each other.

We claim:

1. A light source apparatus comprising:

at least one electrodeless discharge tube containing at least one element which is capable of emitting light in a vaporized state and inactive gas, said electrodeless discharge tube including a first discharging portion, a second light emitting portion extending from and in communication with said first discharging portion, and a third portion for containing said element in a non-vaporized state, said third portion being in communication with said first discharging portion;

first means for applying high-frequency energy to said electrodeless discharge tube to excite said element in said vaporized state into light emission, said first means including a high-frequency coil surrounding said first discharging portion; and second means for maintaining said third portion at a lower temperature than the temperature of both of said first discharging portion and said second light emitting portion.

2. A light source apparatus according to claim 1, wherein said first discharging portion of said electrodeless discharge tube is a first cylindrical portion having a first diameter, and wherein said second light emitting portion is a second cylindrical portion having a second diameter less than said first diameter.

3. A light source apparatus according to claim 2, wherein said cylindrical portion of said second light emitting portion is axially aligned with said first cylindrical portion, and extends from said first discharging portion in a location separate from said third portion.

4. A light source apparatus according to claim 3, wherein said second diameter of said light emitting portion is less than half said first diameter of said first discharging portion.

5. A light source apparatus according to claim 3, wherein said second means includes means for flowing air over said third portion.

6. A light source apparatus according to claim 5, wherein said means for flowing air over said third portion includes a housing having an air inlet and an air outlet.

7. A light source apparatus according to claim 6, wherein said means for flowing air further includes an air blast source communicating with said air inlet.

8. A light source apparatus according to claim 6, wherein said means for flowinng air further includes an exhaust fan arranged at said air outlet.

9. A light source apparatus according to claim 6, wherein said housing surrounds said electrodeless discharge tube and includes a light emitting window disposed adjacent to said second light emitting portion.

10. A light source apparatus according to claim 9, wherein said light emitting window provides a further air outlet.

11. A light source apparatus according to claim 9, wherein said light emitting window is disposed to receive light emitting perpendicularly to the cylindrical axis of said second cylindrical portion of said second light emitting portion.

12. A light source apparatus according to claim 5, wherein said second means maintains said third portion at a substantially constant temperature.

13. A light source apparatus according to claim 2, wherein said second means maintains said third portion at a substantially constant temperature.

14. A light source apparatus according to claim 1, wherein said second means maintains said third portion at a substantially constant temperature.

15. A light source apparatus according to claim 2, wherein a housing is provided for surrounding said electrodeless discharge tube.

16. A light source apparatus according to claim 15, wherein said housing includes a light emitting window disposed adjacent to said second light emitting portion.

17. A light source apparatus according to claim 16, wherein said light emitting window is disposed to receive light emitted perpendicularly to the cylindrical axis of said second cylindrical portion of said second light emitting portion.

18. A light source apparatus according to claim 16, wherein said light emitting window provides an air outlet.

19. A light source apparatus according to claim 16, wherein said second means further includes temperature control means for controlling the temperature of said first discharging portion and said second light emitting portion relative to said third portion.

20. A light source apparatus according to claim 19, wherein said light emitting window is disposed to receive light emitted perpendicularly to the cylindrical axis of said second cylindrical portion of said second light emitting portion.

21. A light source apparatus according to claim 18, wherein said second means maintains said third portion at a substantially constant temperature.

22. A light source apparatus according to claim 21, wherein said second light emitting portion is positioned in a magnetic field.

23. A light source apparatus according to claim 22, wherein light is emitted from said second light emitting portion in a direction different from the direction of said magnetic field.

24. A light source apparatus according to claim 2 wherein said second light emitting portion is positioned in a magnetic field.

25. A light source apparatus according to claim 24, wherein light is emitted from said second light emitting portion in a direction different from the direction of said magnetic field.

26. A light source apparatus comprising:

a first cylindrical portion having a first diameter;

a second cylindrical portion provided in communication with said first cylindrical portion, said second cylindrical portion having a diameter smaller than said first diameter;

a third portion provided in communication with said first cylindrical portion, said third portion including at least one excitable element in a non-vaporized state, said excitable element being capable of emitting light when in a vaporized state and being excited;

a high-frequency coil wound around said first portion;

first means for applying high-frequency energy to said high-frequency coil in order to excite said excitable element in said vaporized state; and second means for maintaining the temperatures of said first and second portions higher than that of said third portion.

27. A light source apparatus according to claim 26, wherein said second means includes a covering over said second portion so as to maintain the temperature of said second portion.

28. A light source apparatus according to claim 26, wherein said second means includes a heater.

29. A light source apparatus according to claim 26, wherein said first portion is disposed axially below said second portion and axially above said third portion.

30. A light source apparatus according to claim 29, wherein only said third portion is located in an air-flow.

31. A light source apparatus according to claim 29, further comprising an air inlet provided near said third portion and an air outlet provided near said second portion.

32. A light source apparatus according to claim 29, wherein said second means includes a heater disposed near said second portion.

33. A light source apparatus according to claim 26, further comprising third means for applying a magnetic field to the light emitted from said second portion.

34. A light source apparatus according to claim 26, further comprising detecting means for detecting a temperature of said third portion and a control means for controlling the temperature of said third portion in response to the output of said detecting means.

35. A light source apparatus comprising:

a longitudinally extending electrodeless discharge tube containing at least one excitable element which is capable of emitting light when in a vaporized state and being excited, said electrodeless discharge tube having a first portion around which a high-frequency coil is wound, a second portion from which the light is emitted in a direction substantially perpendicular to the longitudinal direction of said discharge tube, and a third portion at which said element in a non-vaporized state is provided, said first, second and third portions being intercommunicated;

first means for applying high-frequency energy to said high-frequency coil in order to excite said element in said vaporized state;

second means for maintaining the temperature of said third portion lower than the temperatures of said first and second portions; and a housing for mounting said discharge tube, said housing being provided with a window for emitting said light at a side wall of said housing.

36. A light source according to claim 35, wherein said housing is separated into first and second chambers, said first and second portions being disposed in said first chamber and said third portion being disposed in said second chamber.

37. A light source apparatus according to claim 36, wherein air is caused to flow through said second chamber.

38. A light source apparatus according to claim 36, wherein said second chamber includes a reservoir accommodating a constant-temperature liquid.

39. A light source apparatus according to claim 35, wherein said second portion has a diameter smaller than that of said first portion, and said second portion is disposed in a gap between magnetic poles.

* * * * *